US010014130B2

(12) United States Patent
Mizuno et al.

(10) Patent No.: US 10,014,130 B2
(45) Date of Patent: Jul. 3, 2018

(54) ELECTRONIC DEVICE

(71) Applicant: KYOCERA CORPORATION, Kyoto (JP)

(72) Inventors: Hayato Mizuno, Yokohama (JP); Yasuhito Kanemaki, Katano (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/377,889

(22) Filed: Dec. 13, 2016

(65) Prior Publication Data

US 2017/0178833 A1 Jun. 22, 2017

(30) Foreign Application Priority Data

Dec. 22, 2015 (JP) ..... 2015-250351

(51) Int. Cl.
*H01H 13/702* (2006.01)
*H01H 13/06* (2006.01)
*H01H 13/86* (2006.01)

(52) U.S. Cl.
CPC ..... *H01H 13/06* (2013.01); *H01H 13/702* (2013.01); *H01H 13/86* (2013.01); *H01H 2209/016* (2013.01); *H01H 2223/002* (2013.01)

(58) Field of Classification Search
CPC .. H01H 2223/002; H01H 13/06; H01H 13/86; H01H 13/063; H01H 9/04; H01H 2009/048
USPC ..... 200/302.1, 302.2
See application file for complete search history.

(56) References Cited

U.S. PATENT DOCUMENTS 3,205,326 A * 9/1965 Viscosi ..... H05B 39/105 200/181
2010/0232861 A1* 9/2010 Shibata ..... G06F 1/1662 400/491
2011/0284351 A1* 11/2011 Kitahara ..... H01H 13/06 200/341

FOREIGN PATENT DOCUMENTS

JP 2010-233141 9/1998
JP H10-233141 9/1998

* cited by examiner

*Primary Examiner* — Ahmed Saeed
(74) *Attorney, Agent, or Firm* — Duane Morris LLP

(57) ABSTRACT

An electronic device includes a substrate body serving as a base including a first surface and a second surface facing opposite sides to each other, a dome switch located on the first surface, a waterproof sheet located to include a portion configured to cover the dome switch, and an adhesive layer located on at least part of the waterproof sheet. The waterproof sheet is affixed to the base or another component with the adhesive layer so as to leave a watertight space including the dome switch.

5 Claims, 18 Drawing Sheets

ELECTRONIC DEVICE

CROSS-REFERENCE TO RELATED APPLICATION

The present application claims priority under 35 U.S.C. § 119 to Japanese Patent Application No. 2015-250351, filed on Dec. 22, 2015, entitled "Electronic Device," The content of which is incorporated by reference herein in its entirety.

FIELD

The present disclosure relates to an electronic device.

BACKGROUND

An electronic device may include a dome switch as a switch.

SUMMARY

An electronic device based on the present disclosure includes a base including a first surface and a second surface facing opposite sides to each other, a dome switch located on the first surface, a waterproof sheet located to include a portion configured to cover the dome switch, and an adhesive layer located on at least part of the waterproof sheet. The waterproof sheet is affixed to the base or another component with the adhesive layer so as to leave a watertight space including the dome switch.

The foregoing and other objects, features, aspects and advantages of the present disclosure will become more apparent from the following detailed description of the present disclosure when taken in conjunction with the accompanying drawings.

DETAILED DESCRIPTION

The drawings are not necessarily depicted faithfully in an actual proportion, but may be depicted in an exaggerated proportion for ease of description. In the following description, when referring to the concept of upper or lower, it means relative upper or lower in a depicted posture, rather than absolute upper or lower.

A "dome switch" as used herein refers to a switch obtained by convexly locating a curved film made of metal and another material on a surface of a substrate, the switch being elastically deformed so as to be concave when this curved portion is pressed, causing contacts located on the inner side of the curved portion to come into contact with each other to bring about an electrically ON state, the curved portion returning to its original shape by its resilience when pressing is stopped to bring about an OFF state. The dome switch as used herein may be called a dome type switch, a membrane switch, a sheet switch, and the like. Among them, one with the curved portion mainly made of metal is also called a metal dome.

First Embodiment

Figure 1:
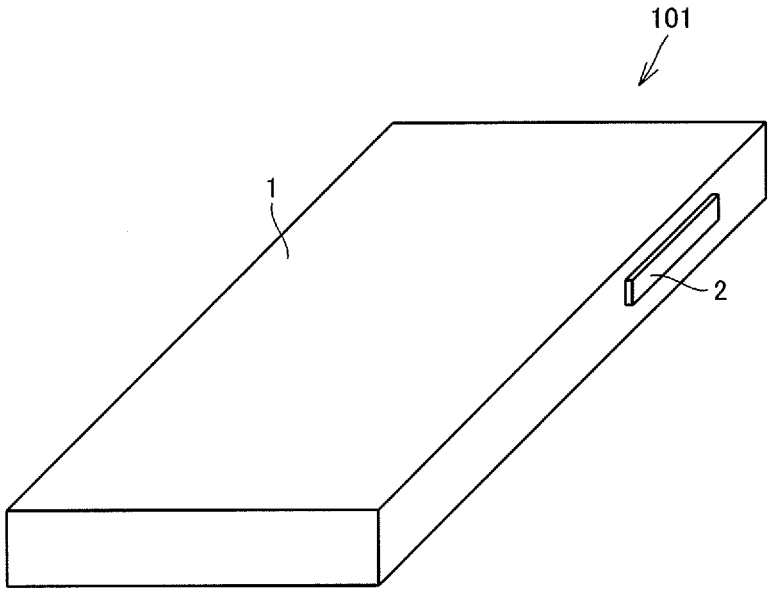
FIG. 1 is a perspective view of an electronic device according to a first embodiment based on the present disclosure.
Figure 2:
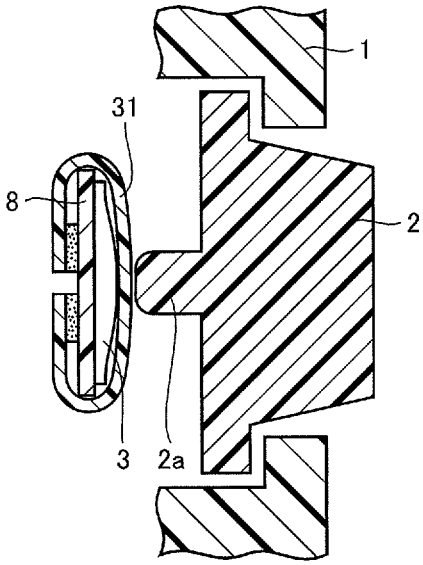
FIG. 2 is a partial cross sectional view of a button and its surroundings of the electronic device according to the first embodiment based on the present disclosure.

Referring to FIGS. 1 to 11, an electronic device according to a first embodiment based on the present disclosure will be described. FIG. 1 shows the appearance of the electronic device according to the first embodiment. An electronic device 101 includes a housing 1 and a button 2. Housing 1 may actually include as appropriate a display, a manual operation button, a speaker, and the like, neither shown here. FIG. 2 shows a cross section of button 2 and its surroundings in electronic device 101. Push button 2 located in an opening of housing 1 includes a pressing element 2*a* on the back side thereof. Pressing element 2*a* is located so as to indirectly press a dome switch 3 located on the inner side of housing 1. Dome switch 3 is located on a substrate 8. A waterproof sheet 31 with an adhesive layer is located between dome switch 3 and pressing element 2*a*. The shape of pressing element 2*a* shown in FIG. 2 is merely an example, and is not limited to this shape. Pressing element 2*a* may not necessarily be present, but any part of push button 2 may be configured to face dome switch 3.

Figure 3:
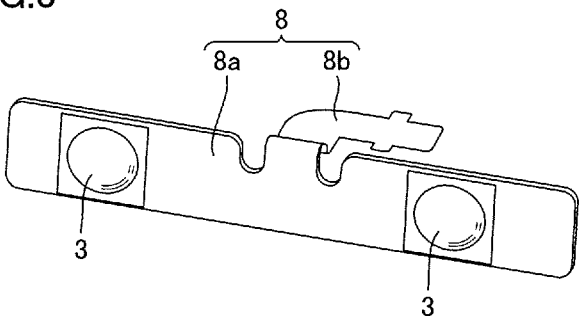
FIG. 3 is a perspective view of a substrate included in the electronic device according to the first embodiment based on the present disclosure.

FIG. 3 shows substrate 8 shown in FIG. 2 as taken out alone. Substrate 8 includes a substrate body 8*a* and a flexible portion 8*b*. Two dome switches 3 are located on a surface of substrate body 8*a*. Flexible portion 8*b* extends from approximately the center of substrate body 8*a*. The place where flexible portion 8*b* is connected to substrate body 8*a* is located between two dome switches 3. Although two dome switches 3 shall be located in this example, the number of dome switches 3 located on one substrate body 8*a* is not limited to two, but may be in another number.

Figure 4:
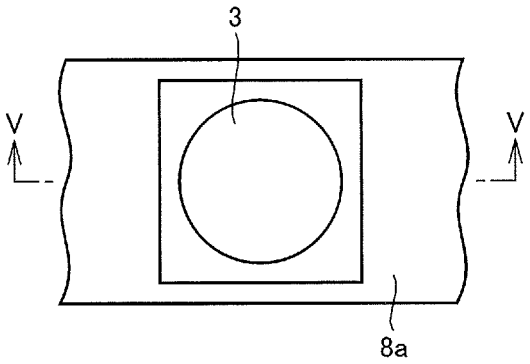
FIG. 4 is a partial enlarged view of the substrate included in the electronic device according to the first embodiment based on the present disclosure.
Figure 5:
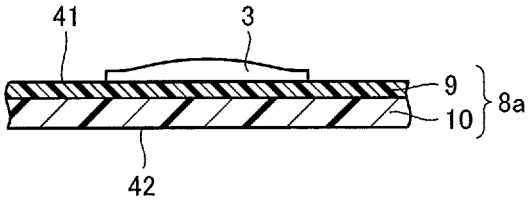
FIG. 5 is a cross sectional view taken along the line V-V in FIG. 4.

Dome switch 3 shown in FIG. 3 and its surroundings are shown in FIG. 4 enlargedly. FIG. 4 shows dome switch 3 and its surroundings as seen in the direction perpendicular to the surface of substrate body 8*a*. FIG. 5 is a cross sectional view taken along the line V-V in FIG. 4. Substrate body 8*a* includes a first surface 41 and a second surface 42 facing opposite sides to each other. In the example shown here, substrate body 8*a* includes a first layer 9 and a second layer 10. Substrate body 8*a* may be of such a laminated structure including two or more layers. For example, first layer 9 may be an extension of flexible portion 8*b*, and second layer 10 may serve as a supporting layer.

Figure 6:
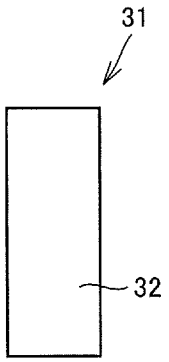
FIG. 6 is a first plan view of a waterproof sheet with an adhesive layer included in the electronic device according to the first embodiment based on the present disclosure.
Figure 7:
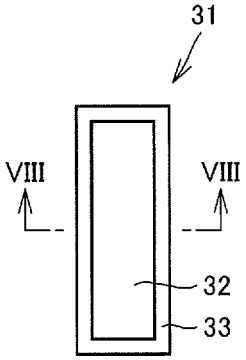
FIG. 7 is a second plan view of the waterproof sheet with an adhesive layer included in the electronic device according to the first embodiment based on the present disclosure.
Figure 8:
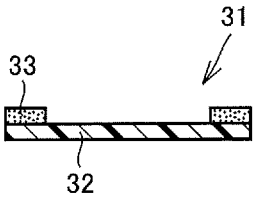
FIG. 8 is a cross sectional view taken along the line VIII-VIII in FIG. 7.

FIG. 6 shows waterproof sheet 31 shown in FIG. 2 as taken out alone. Waterproof sheet 31 has a rectangular outer shape. FIG. 7 shows waterproof sheet 31 as turned over from the state shown in FIG. 6. Waterproof sheet 31 includes a waterproof sheet 32 and an adhesive layer 33. Adhesive layer 33 is located along the outer edge of waterproof sheet 32. FIG. 8 is a cross sectional view taken along the line VIII-VIII in FIG. 7.

Figure 9:
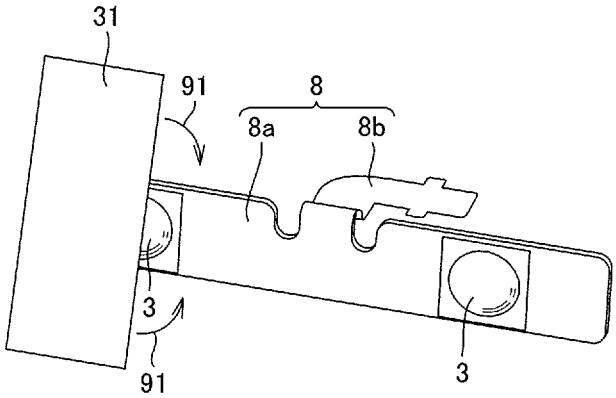
FIG. 9 is an explanatory drawing showing how to attach the waterproof sheet with an adhesive layer to the substrate included in the electronic device according to the first embodiment based on the present disclosure.
Figure 10:
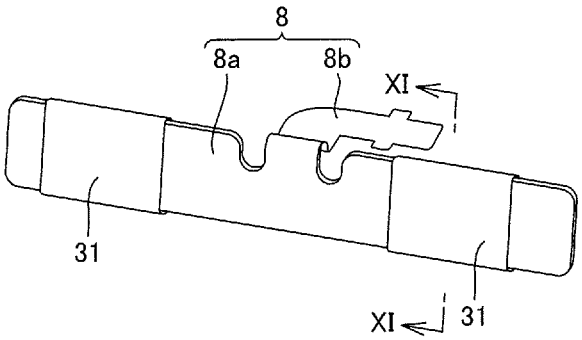
FIG. 10 is a perspective view of a state where the waterproof sheet with an adhesive layer has been attached to the substrate included in the electronic device according to the first embodiment based on the present disclosure.
Figure 11:
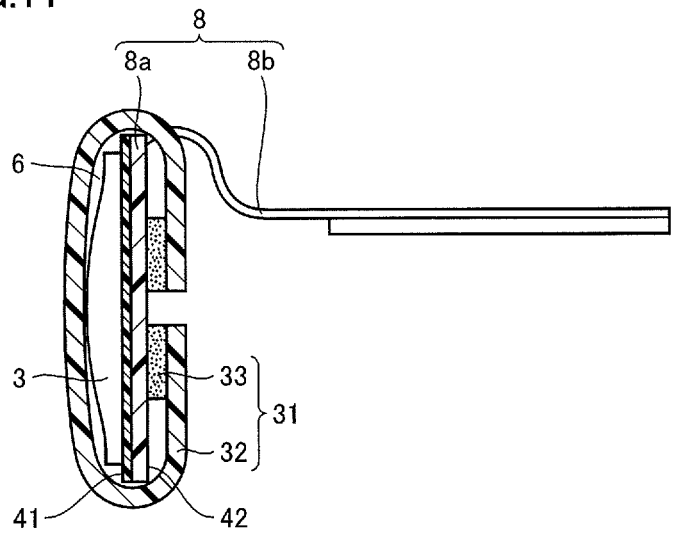
FIG. 11 is a cross sectional view taken along the line XI-XI in FIG. 10.

FIG. 9 shows how to attach waterproof sheet 31 to substrate 8. Waterproof sheet 31 is wrapped around a place where dome switch 3 is located in substrate body 8*a*. As shown in FIG. 9, waterproof sheet 31 is overlaid on dome switch 3 such that the longitudinal direction of waterproof sheet 31 is orthogonal to the longitudinal direction of substrate body 8*a*, and wrapped around as indicated by an arrow 91. One waterproof sheet 31 is wrapped around corresponding one of a plurality of dome switches 3. As a result, the state shown in FIG. 10 is brought about. FIG. 11 is a cross sectional view taken along the line XI-XI in FIG. 10. Waterproof sheet 31 applied to substrate body 8*a* from the first surface 41 side is folded back at the upper and lower ends of substrate body 8*a* to wrap substrate body 8*a*. Waterproof sheet 31 is affixed with adhesive layer 33 to the surface of substrate body 8*a* opposite to the surface on which dome switch 3 is located, namely, second surface 42.

In summary, the structure of the electronic device according to the first embodiment can be expressed as follows. Electronic device 101 includes substrate body 8*a* serving as a base including first surface 41 and second surface 42 facing the opposite sides to each other, dome switch 3 located on first surface 41, waterproof sheet 32 located to include a portion covering dome switch 3, and adhesive layer 33 located on at least part of waterproof sheet 32. Waterproof sheet 32 is affixed with adhesive layer 33 to substrate body 8*a* serving as a base so as to leave a watertight space 6 including dome switch 3.

The expression "watertight space 6 including dome switch 3" herein does not necessarily mean that there is a gap around dome switch 3. There may or may not be a gap around dome switch 3 in space 6. The volume occupied by dome switch 3 may be the whole of space 6. Gas may be moved in and out of dome switch 3 when dome switch 3 alternates between a pressed state and an unpressed state. For example, in the unpressed state, dome switch 3 may be present so as to occupy space 6 as a whole. In the pressed state, a gap may be present in space 6 aside from dome switch 3 by at least part of gas in dome switch 3 being discharged therefrom. Alternatively, there may already be a gap in the space aside from dome switch 3 even in the unpressed state of dome switch 3.

In the first embodiment, watertight space 6 including dome switch 3 is left by affixing waterproof sheet 32 with adhesive layer 33. Thus, there is no water around dome switch 3. Accordingly, water can be unlikely to enter dome switch 3. Since water is unlikely to enter dome switch 3, the electronic device according to the first embodiment can be an electronic device whose button can be operated underwater.

As described in the first embodiment, waterproof sheet 32 may be folded back to second surface 42, and may be affixed to second surface 42 with adhesive layer 33. By employing this structure, substrate 8 and waterproof sheet 32 are combined together with adhesive layer 33 located therebetween to leave watertight space 6 including dome switch 3 without requiring any other component suitable for affixation around substrate 8, which increases design flexibility.

In the first embodiment, substrate 8 shall include substrate body 8*a* having a certain degree of rigidity and flexible portion 8*b*, and substrate body 8*a* shall correspond to a base, but this is merely an example. The base is not limited to one having rigidity. The base is not limited to a plate-like one, but may have another shape. The base is not limited to one having rigidity, but may be flexible. This shall also apply to embodiments to be described below. Although the first embodiment describes substrate 8 as including substrate body 8*a* and flexible portion 8*b* as an example, any component serving as a base will suffice, and the presence of flexible portion 8*b* is not indispensable.

Second Embodiment

Referring to FIGS. 12 to 17, an electronic device according to a second embodiment based on the present disclosure will be described. Since the appearance of the electronic device is similar to that described in the first embodiment, description thereof will not be repeated.

Figure 12:
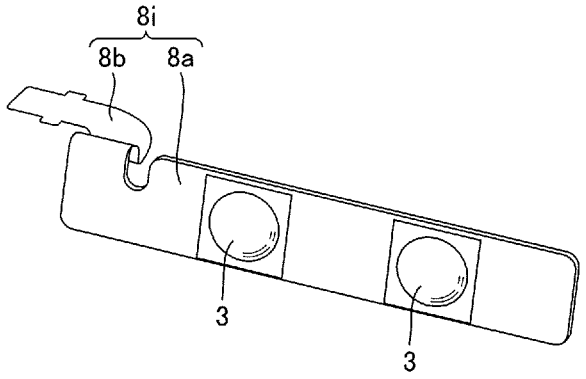
FIG. 12 is a perspective view of a substrate included in an electronic device according to a second embodiment based on the present disclosure.
Figure 13:
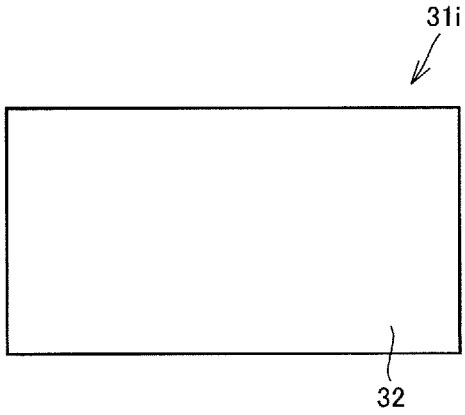
FIG. 13 is a first plan view of a waterproof sheet with an adhesive layer included in the electronic device according to the second embodiment based on the present disclosure.
Figure 14:
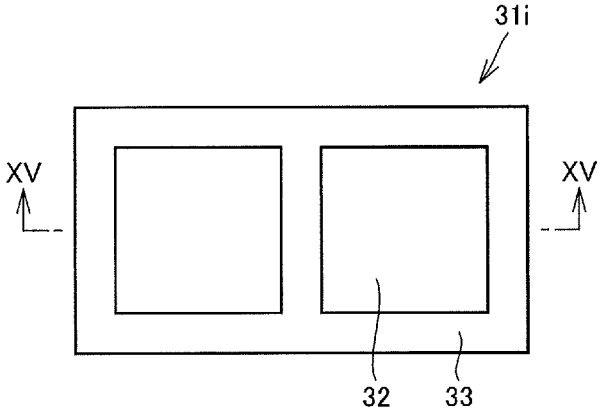
FIG. 14 is a second plan view of the waterproof sheet with an adhesive layer included in the electronic device according to the second embodiment based on the present disclosure.
Figure 15:
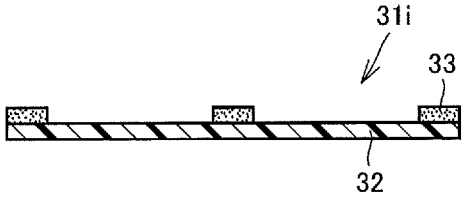
FIG. 15 is a cross sectional view taken along the line XV-XV in FIG. 14.

The electronic device according to the second embodiment includes a substrate 8*i* as shown in FIG. 12 instead of substrate 8 described in the first embodiment. In substrate 8*i*, flexible portion 8*b* extends from one end of substrate body 8*a* unlike substrate 8. In the remaining portion, substrate 8*i* is basically similar in structure to substrate 8. The electronic device according to the second embodiment includes a waterproof sheet 31*i* as shown in FIG. 13 instead of waterproof sheet 31 described in the first embodiment. Waterproof sheet 31*i* has a rectangular outer shape. FIG. 14 shows waterproof sheet 31*i* as turned over from the state shown in FIG. 13. Waterproof sheet 31*i* includes waterproof sheet 32 and adhesive layer 33. Adhesive layer 33 is not only located along the outer edge of waterproof sheet 32, but also located across the center. FIG. 15 is a cross sectional view taken along the line XV-XV in FIG. 14.

Figure 16:
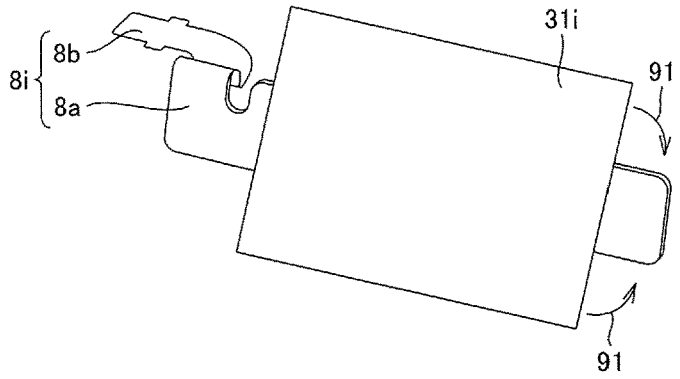
FIG. 16 is an explanatory drawing showing how to attach the waterproof sheet with an adhesive layer to the substrate included in the electronic device according to the second embodiment based on the present disclosure.
Figure 17:
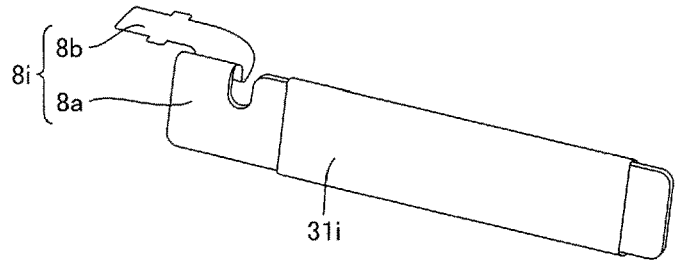
FIG. 17 is a perspective view of a state where the waterproof sheet with an adhesive layer has been attached to the substrate included in the electronic device according to the second embodiment based on the present disclosure.

In the electronic device according to the second embodiment, waterproof sheet 31*i* is attached to substrate 8*i* as shown in FIG. 16. One waterproof sheet 31*i* covers two dome switches 3, and wrapped around as indicated by arrow 91. As a result, the electronic device according to the second embodiment is brought into the structure as shown in FIG. 17.

In the second embodiment, effects similar to those of the first embodiment can also be obtained. In the example described in the second embodiment, the number of dome switches 3 is two, but the number of dome switches 3 may be other than two. In FIG. 14, adhesive layer 33 includes a portion located so as to traverse the center of waterproof sheet 32, and waterproof sheet 32 is divided into two sections. If the number of dome switches is other than two, waterproof sheet 32 may be divided into a plurality of sections in correspondence to the number of dome switches. By wrapping the waterproof sheet around the substrate, a plurality of watertight spaces are left such that respective dome switches may be housed individually. The plurality of dome switches may be located in a single section.

Third Embodiment

Referring to FIGS. 18 to 22, an electronic device according to a third embodiment based on the present disclosure will be described. Since the appearance of the electronic device is similar to that described in the first embodiment, description thereof will not be repeated.

Figure 18:
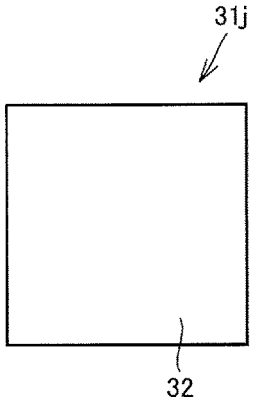
FIG. 18 is a first plan view of a waterproof sheet with an adhesive layer included in an electronic device according to a third embodiment based on the present disclosure.
Figure 19:
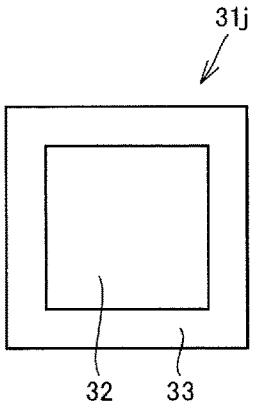
FIG. 19 is a second plan view of the waterproof sheet with an adhesive layer included in the electronic device according to the third embodiment based on the present disclosure.
Figure 20:
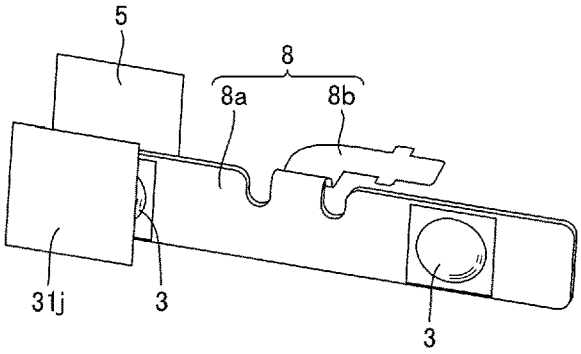
FIG. 20 is an explanatory drawing showing how to attach the waterproof sheet with an adhesive layer to a substrate included in the electronic device according to the third embodiment based on the present disclosure.
Figure 21:
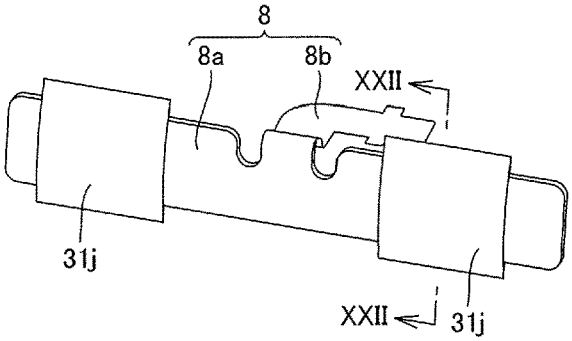
FIG. 21 is a perspective view of a state where the waterproof sheet with an adhesive layer has been attached to the substrate included in the electronic device according to the third embodiment based on the present disclosure.
Figure 22:
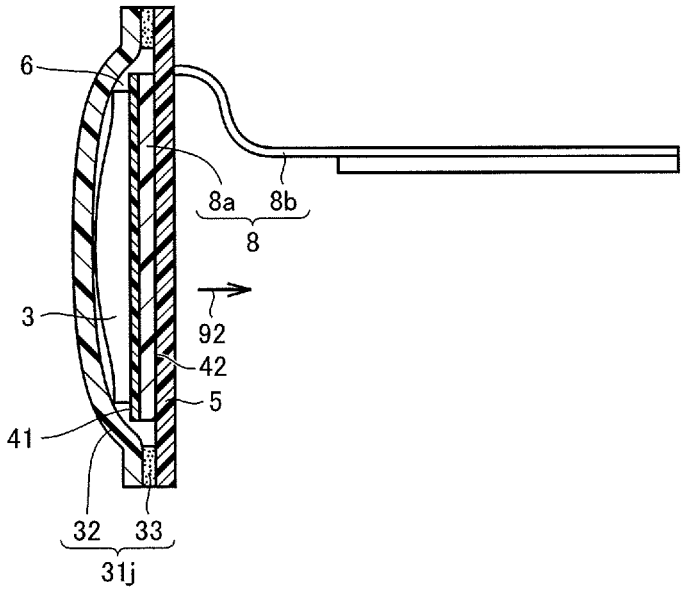
FIG. 22 is a cross sectional view taken along the line XXII-XXII in FIG. 21.

The electronic device according to the third embodiment includes a waterproof sheet 31*j* as shown in FIG. 18 instead of waterproof sheet 31 described in the first embodiment. FIG. 19 shows waterproof sheet 31*j* as turned over from the state shown in FIG. 18. Adhesive layer 33 is located along the outer edge of waterproof sheet 31*j* Waterproof sheet 31*j* includes waterproof sheet 32 and adhesive layer 33. The electronic device according to the third embodiment includes substrate 8 which is identical to that described in the first embodiment. Waterproof sheet 31*j* is attached to substrate 8 as shown in FIG. 20. Here, a first sheet 5 is used. Waterproof sheet 31*j* and first sheet 5 may be of approximately the same size and approximately the same shape. Waterproof sheet 31*j* is overlaid so as to cover dome switch 3 located on substrate body 8*a* of substrate 8, and first sheet 5 is overlaid from the opposite side of substrate body 8*a*. As a result, the electronic device according to the third embodiment is brought into the structure as shown in FIG. 21. FIG. 22 is a cross sectional view taken along the line XXII-XXII in FIG. 21.

In summary, the structure of the electronic device according to the third embodiment can be expressed as follows. The electronic device according to the third embodiment includes substrate body 8*a* serving as a base including first surface 41 and second surface 42 facing the opposite sides to each other, dome switch 3 located on first surface 41, waterproof sheet 32 located to include a portion covering dome switch 3, and adhesive layer 33 located on at least part of waterproof sheet 32. Waterproof sheet 32 is affixed to another component with adhesive layer 33 so as to leave watertight space 6 including dome switch 3. The other component is first sheet 5 located along second surface 42 and as seen from the first surface 41 side, protruding outward with respect to substrate body 8*a* serving as a base. Waterproof sheet 32 is affixed to first sheet 5 with adhesive layer 33.

In the third embodiment, effects similar to those of the first embodiment can also be obtained. Since it is not necessary to bend the waterproof sheet in the third embodiment, installation of waterproof sheet 31*j* is easy. If a double-sided adhesive sheet is adopted as first sheet 5, it can also be fixed directly to the housing or the like utilizing the surface of first sheet 5 opposite to substrate 8, as indicated by an arrow 92 in FIG. 22.

Fourth Embodiment

Figure 23:
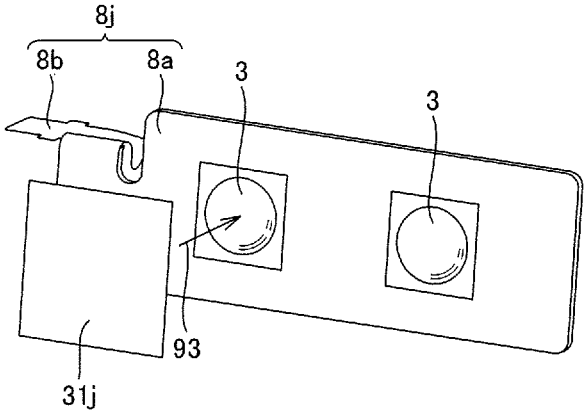
FIG. 23 is an explanatory drawing showing how to attach a waterproof sheet with an adhesive layer to a substrate included in an electronic device according to a fourth embodiment based on the present disclosure.
Figure 24:
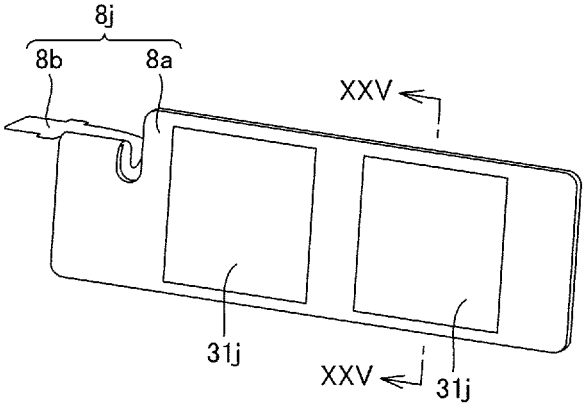
FIG. 24 is a perspective view of a state where the waterproof sheet with an adhesive layer has been attached to the substrate included in the electronic device according to the fourth embodiment based on the present disclosure.
Figure 25:
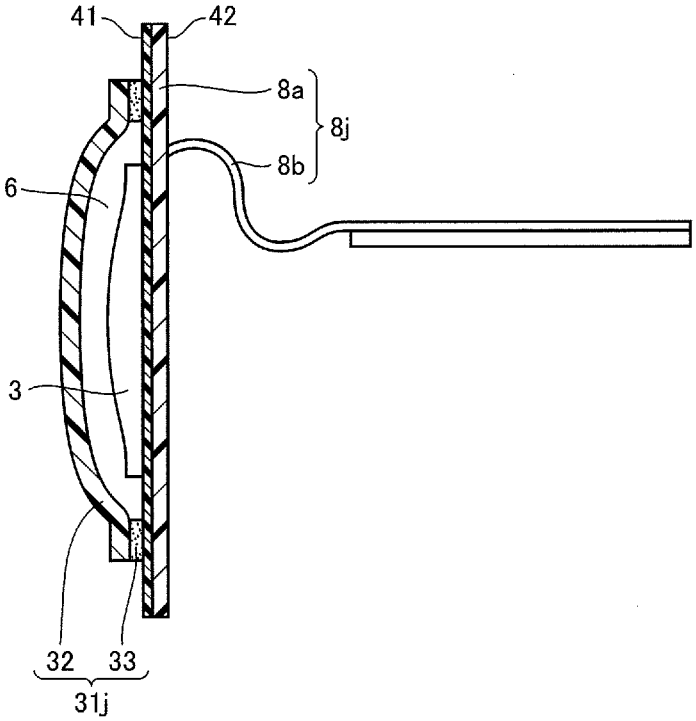
FIG. 25 is a cross sectional view taken along the line XXV-XXV in FIG. 24.

Referring to FIGS. 23 to 25, an electronic device according to a fourth embodiment based on the present disclosure will be described. Since the appearance of the electronic device is similar to that described in the first embodiment, description thereof will not be repeated.

The electronic device according to the fourth embodiment includes a substrate 8*j* as shown in FIG. 23 instead of substrate 8 described in the first embodiment. In substrate 8*j*, flexible portion 8*b* extends from one end of substrate body 8*a* unlike substrate 8. Substrate 8*j* has a larger width than substrate 8. In the remaining portion, substrate 8*j* is basically similar in structure to substrate 8. The electronic device according to the fourth embodiment includes waterproof sheet 31*j* described in the third embodiment. As indicated by an arrow 93 in FIG. 23, waterproof sheet 31*j* is affixed so as to cover each of dome switches 3 located on substrate 8*j*. As a result, the electronic device according to the fourth embodiment is brought into the structure as shown in FIG. 24. FIG. 25 is a cross sectional view taken along the line XXV-XXV in FIG. 24.

In the electronic device according to the fourth embodiment, waterproof sheet 32 is affixed to first surface 41 with adhesive layer 33.

In the fourth embodiment, effects similar to those of the first embodiment can also be obtained. In the fourth embodiment, watertight space 6 can be left only by means of the first surface of substrate body 8*a*. The second surface of substrate body 8*a* can be used for another application. Since waterproof sheet 31*j* only needs to be affixed to substrate body 8*a* from one side in the fourth embodiment, the affixing operation is easy.

Fifth Embodiment

Referring to FIGS. 26 to 33, an electronic device according to a fifth embodiment based on the present disclosure will be described. Since the appearance of the electronic device is similar to that described in the first embodiment, description thereof will not be repeated.

Figure 26:
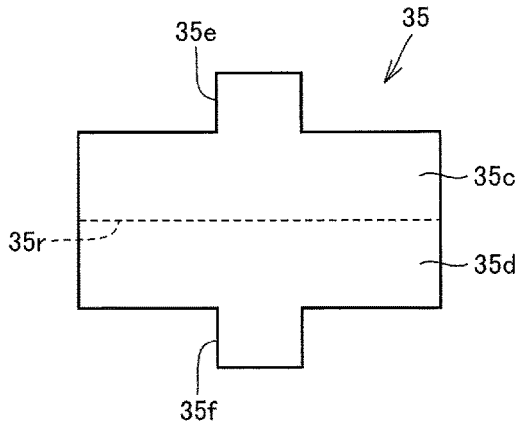
FIG. 26 is a plan view of a waterproof sheet included in an electronic device according to a fifth embodiment based on the present disclosure.

The electronic device according to the fifth embodiment includes a waterproof sheet 35 as shown in FIG. 26 instead of waterproof sheet 31 described in the first embodiment. Waterproof sheet 35 may not include an adhesive layer. Waterproof sheet 35 has a fold 35*r*. In FIG. 26, fold 35*r* is schematically indicated by the broken line. In a state before waterproof sheet 35 is bent, fold 35*r* is not necessarily present as a visible line. Waterproof sheet 35 may have a symmetrical shape with respect to fold 35*r*. Waterproof sheet 35 includes a first portion 35*c* and a second portion 35*d* with fold 35*r* serving as a boundary line. First portion 35*c* includes a protrusion 35*e*. Second portion 35*d* includes a protrusion 35*f*.

Figure 27:
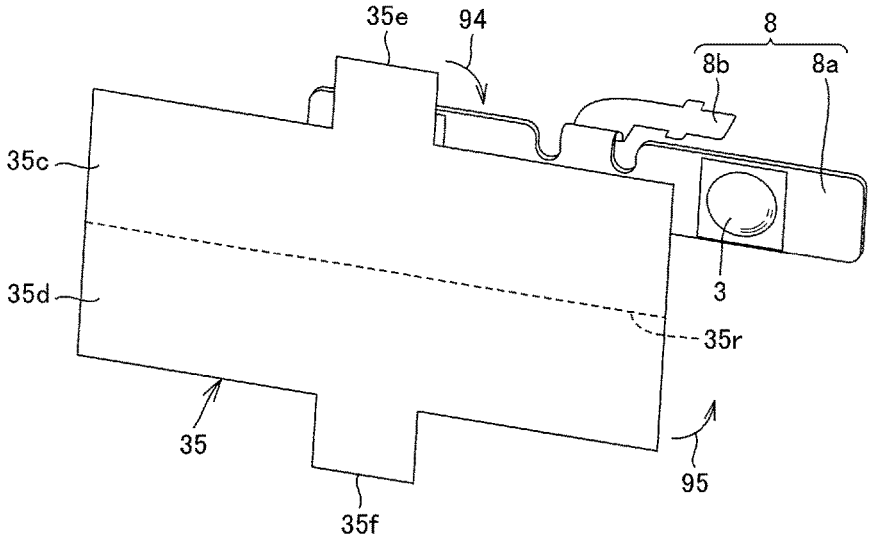
FIG. 27 is a first explanatory drawing showing how to attach the waterproof sheet to a substrate included in the electronic device according to the fifth embodiment based on the present disclosure.
Figure 28:
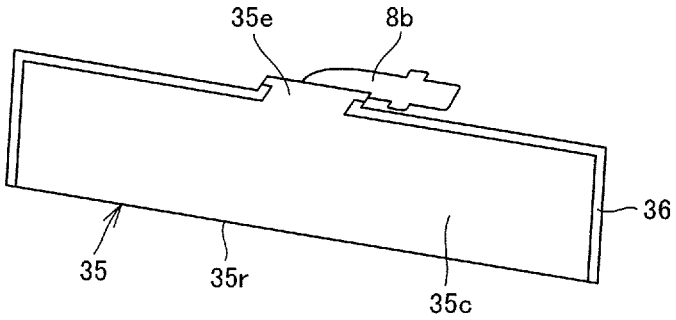
FIG. 28 is a second explanatory drawing showing how to attach the waterproof sheet to the substrate included in the electronic device according to the fifth embodiment based on the present disclosure.
Figure 29:
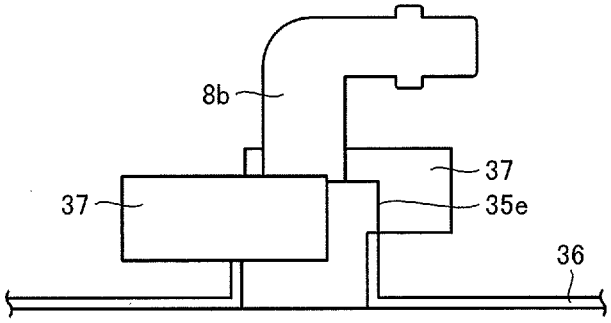
FIG. 29 is a third explanatory drawing showing how to attach the waterproof sheet to the substrate included in the electronic device according to the fifth embodiment based on the present disclosure.

Waterproof sheet 35 is attached to substrate 8 as shown in FIG. 27. First portion 35*c* is applied to follow substrate body 8*a*, and protrusion 35*e* is bent as indicated by an arrow 94. Protrusion 35*e* conforms to flexible portion 8*b*. Second portion 35*d* is bent so as to cover the opposite surface of substrate 8 as indicated by an arrow 95. At most places where the edge of first portion 35*c* and the edge of second portion 35*d* meet, the edges are heat welded to create a heat weld 36 as shown in FIG. 28. As shown in FIG. 29, waterproof adhesive sheets 37 are affixed from both the upper and lower sides to the place where protrusion 35*e*, flexible portion 8*b* and protrusion 35*f* (hidden behind protrusion 35*e* in FIG. 29) overlap one another. Two waterproof adhesive sheets 37 sandwich protrusions 35*e* and 35*f*. The state shown in FIG. 30 is thus brought about.

Figure 30:
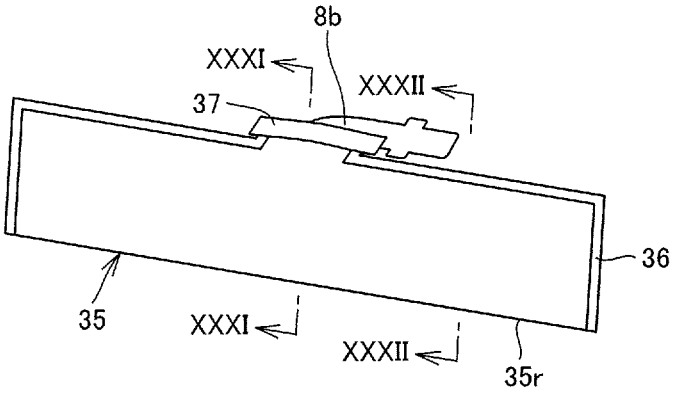
FIG. 30 is a perspective view of a state where the waterproof sheet has been attached to the substrate included in the electronic device according to the fifth embodiment based on the present disclosure.
Figure 31:
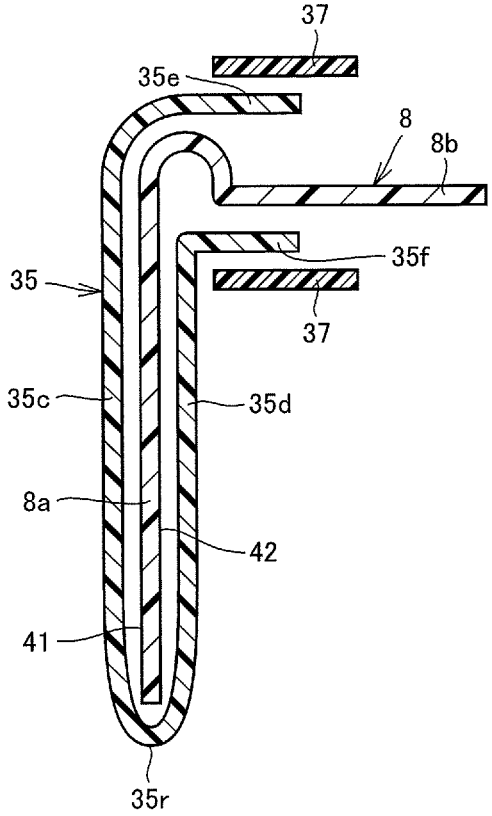
FIG. 31 is an exploded view corresponding to the cross sectional view taken along the line XXXI-XXXI in FIG. 30.
Figure 32:
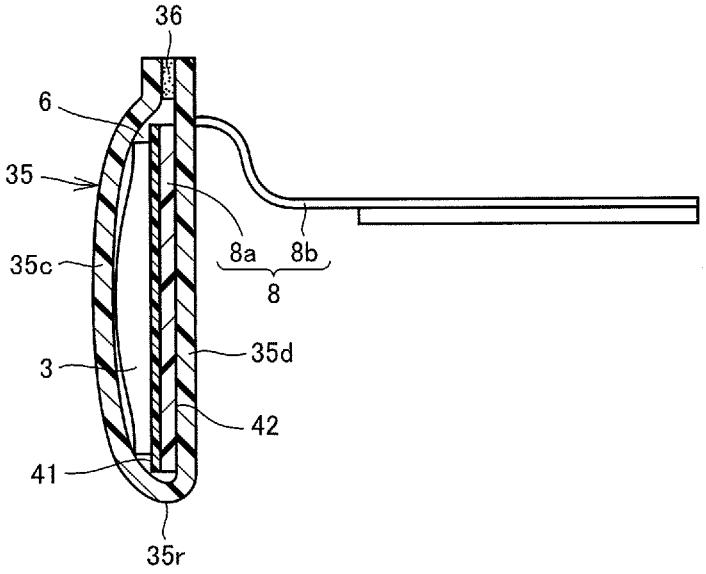
FIG. 32 is a cross sectional view taken along the line XXXII-XXXII in FIG. 30.
Figure 33:
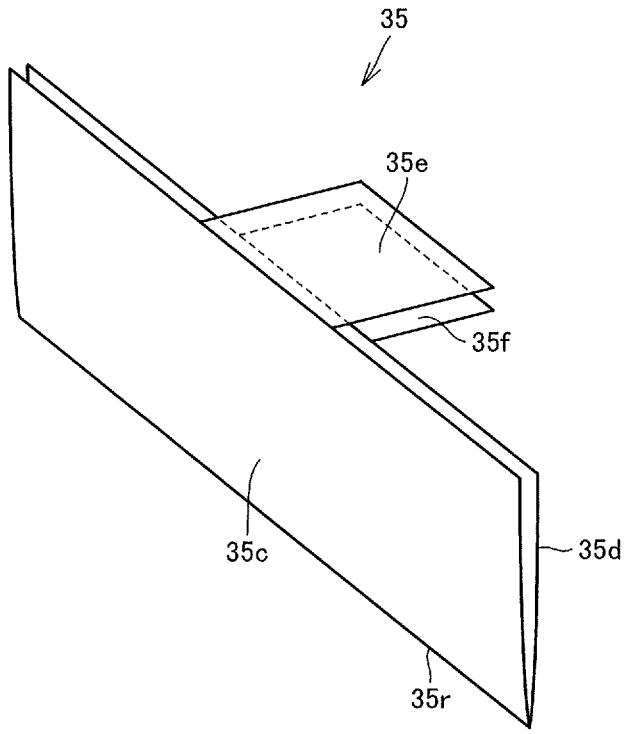
FIG. 33 is a schematic view of the shape of the waterproof sheet after being attached to the substrate.

FIG. 31 is an exploded view corresponding to the cross sectional view taken along the line XXXI-XXXI in FIG. 30. In FIG. 31, the left end of flexible portion 8*b* in the drawing is roundish so as to be convex upward, but such a roundish portion is not indispensable. When sandwiching protrusions 35*e* and 35*f* by two waterproof adhesive sheets 37, adhesive sheets 37 may be affixed avoiding the roundish portion, or may be affixed after being bent to conform to the shape of the roundish portion. FIG. 32 is a cross sectional view taken along the line XXXII-XXXII in FIG. 30. FIG. 33 schematically shows the shape of waterproof sheet 35 independently in the state shown in FIG. 30. First portion 35*c* and second portion 35*d* are folded along fold 35*r*, and protrusions 35*e* and 35*f* are bent toward the back side.

In summary, the structure of the electronic device according to the fifth embodiment can be expressed as follows. The electronic device according to the fifth embodiment includes substrate body 8*a* serving as a base including first surface 41 and second surface 42 facing the opposite sides to each other, dome switch 3 located on first surface 41, waterproof sheet 35 located to include a portion covering dome switch 3, and flexible portion 8*b* extending from substrate body 8*a* serving as a base. Waterproof sheet 35 integrally includes first portion 35*c* covering first surface 41 and second portion 35*d* covering second surface 42 so as to enclose substrate body 8*a* serving as a base. Waterproof sheet 35 is bent between first portion 35*c* and second portion 35*d*, and a section where first portion 35*c* and second portion 35*d* meet each other is bonded so as to leave watertight space 6 including dome switch 3. In the expression that waterproof sheet 35 "is bent between first portion 35*c* and second portion 35*d*", the "bent" state shall include not only a state where it is bent without an apparent fold, but also a state where it is bent to create an apparent fold. The "bent" state also includes a state where it is bent in a curve as a matter of course. The description in the fifth embodiment that waterproof sheet 35 is folded in half along fold 35*r* merely indicates an example of how to bend.

Since the integral waterproof sheet is bent to enclose substrate body 8*a* and to leave the watertight space in the fifth embodiment, effects similar to those of the first embodiment can be obtained.

As described in the fifth embodiment, at least part of the section where first portion 35*c* and second portion 35*d* meet each other may be heat weld 36 where first portion 35*c* and second portion 35*d* have been bonded together. By employing this structure, since the portion which should be closed is sealed by heat welding, sealing can be performed even if the waterproof sheet includes a narrow margin. Since sealing is performed by heat welding, no adhesive layer is required.

As described in the fifth embodiment, at least part of the section where first portion 35*c* and second portion 35*d* meet each other is sandwiched between waterproof adhesive sheets 37 from the both sides with first portion 35*c* and second portion 35*d* being overlaid one on the other. One waterproof adhesive sheet 37 seals the place where the end of first portion 35*c* is in contact with flexible portion 8*b*, and the other waterproof adhesive sheet 37 seals the place where the end of second portion 35*d* is in contact with flexible portion 8*b*. By employing this structure, the periphery of the flexible portion can be sealed reliably.

Figure 34:
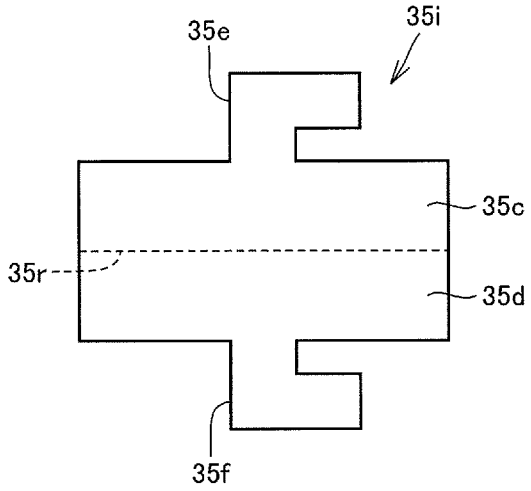
FIG. 34 is a plan view of a variation of the waterproof sheet included in the electronic device according to the fifth embodiment based on the present disclosure.

The protrusions of the waterproof sheet may have a shape conforming to the shape of the flexible portion of the substrate. When the flexible portion presents an L-shape, a waterproof sheet 35*i* shown in FIG. 34, for example, may be adopted. In waterproof sheet 35*i*, protrusions 35*e* and 35*f* each present an L-shape. Protrusions 35*e* and 35*f* are in mirror image relationship with respect to each other.

Sixth Embodiment

Referring to FIGS. 35 to 41, an electronic device according to a sixth embodiment based on the present disclosure will be described. Since the appearance of the electronic device is similar to that described in the first embodiment, description thereof will not be repeated.

Figure 35:
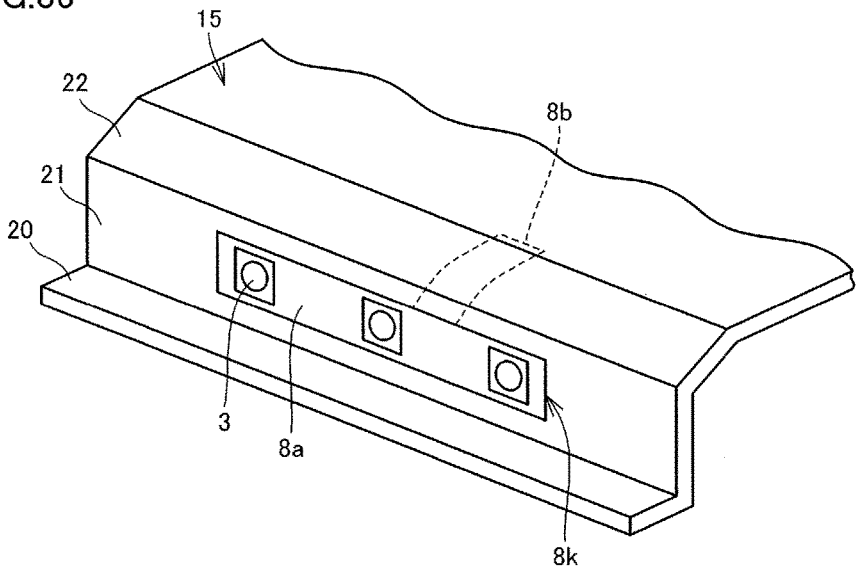
FIG. 35 is a fragmentary perspective view of a housing included in an electronic device according to a sixth embodiment based on the present disclosure.

FIG. 35 shows part of a housing 15. The electronic device according to the sixth embodiment includes housing 15. In FIG. 35, housing 15 is drawn in a constant width for ease of description, but actually may extend further to the upper left and the lower right in the drawing. Housing 15 includes a bottom surface 20, a side surface 21 and a slope 22. A substrate 8*k* is located on housing 15. Substrate 8*k* includes substrate body 8*a* and flexible portion 8*b*. Substrate body 8*a* is located so as to overlap side surface 21 of housing 15.

Figure 36:
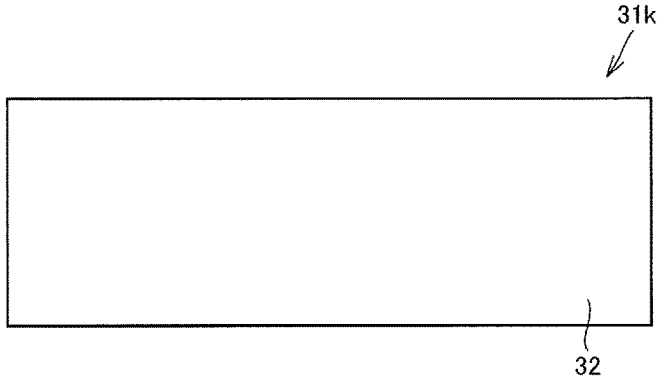
FIG. 36 is a first plan view of a waterproof sheet with an adhesive layer included in the electronic device according to the sixth embodiment based on the present disclosure.
Figure 37:
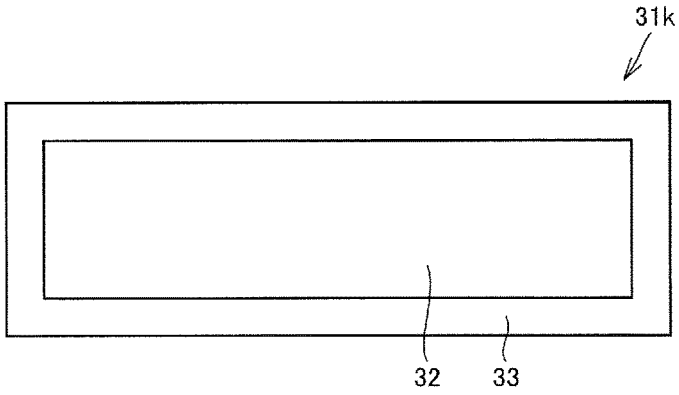
FIG. 37 is a second plan view of the waterproof sheet with an adhesive layer included in the electronic device according to the sixth embodiment based on the present disclosure.

FIG. 36 shows a waterproof sheet 31*k* independently. The electronic device according to the sixth embodiment includes waterproof sheet 31*k* Waterproof sheet 31*k* has a rectangular outer shape. FIG. 37 shows waterproof sheet 31*k* as turned over from the state shown in FIG. 36. Waterproof sheet 31*k* includes waterproof sheet 32 and adhesive layer 33.

Figure 38:
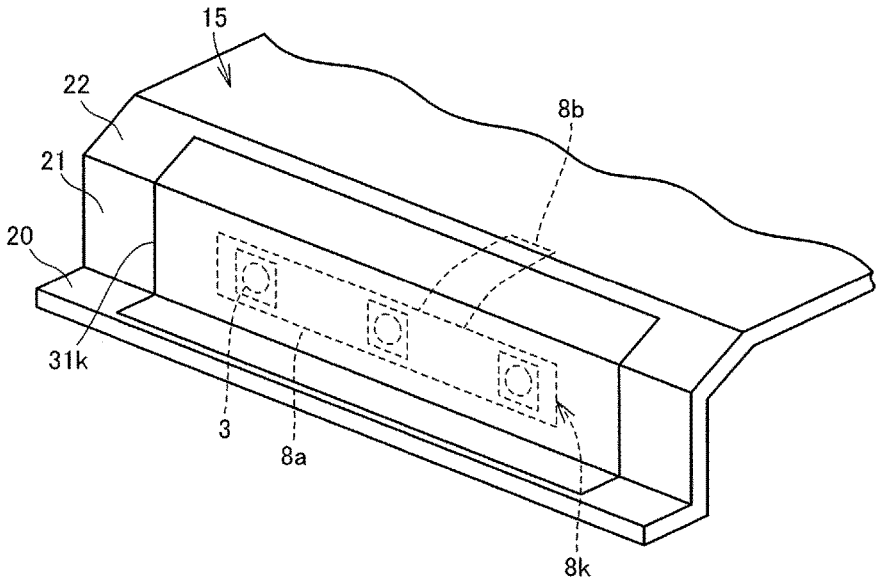
FIG. 38 is a perspective view of a state where the waterproof sheet with an adhesive layer has been attached to the housing included in the electronic device according to the sixth embodiment based on the present disclosure.
Figure 39:
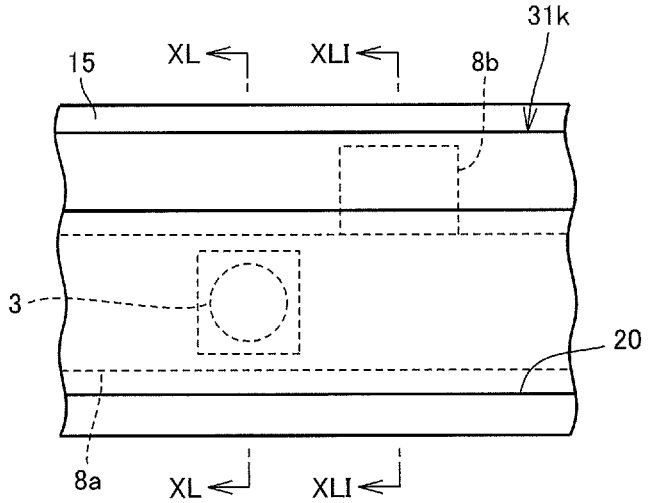
FIG. 39 is a partial enlarged view of the structure shown in FIG. 38 as seen in the direction perpendicular to a substrate body.
Figure 40:
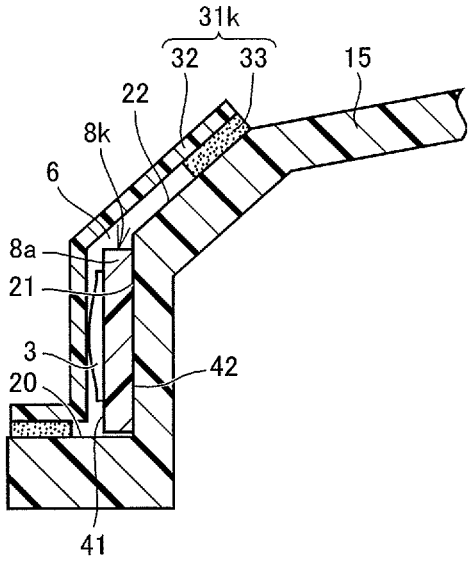
FIG. 40 is a cross sectional view taken along the line XL-XL in FIG. 39.
Figure 41:
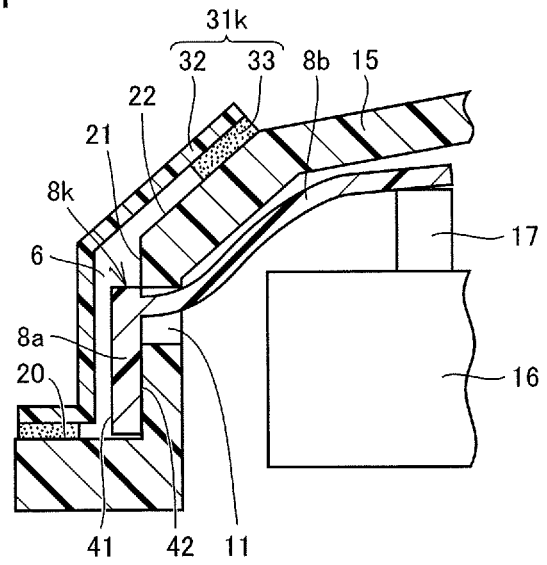
FIG. 41 is a cross sectional view taken along the line XLI-XLI in FIG. 39.

FIG. 38 shows a state where waterproof sheet 31*k* has been attached to housing 15. Waterproof sheet 31*k* is affixed so as to range from bottom surface 20 over side surface 21 to slope 22 of housing 15. Substrate body 8*a* is completely hidden by waterproof sheet 31*k* FIG. 39 shows the structure shown in FIG. 38 as seen in the direction perpendicular to substrate body 8*a*. FIG. 40 is a cross sectional view taken along the line XL-XL in FIG. 39. Second surface 42 of substrate body 8*a* is in contact with side surface 21 of housing 15. Waterproof sheet 31*k* is adhered to housing 15 with adhesive layer 33. Watertight space 6 is left in an area enclosed by adhesive layer 33 on the back side of waterproof sheet 31*k* Substrate body 8*a* is located in this watertight space 6. Dome switch 3 located on first surface 41 of substrate body 8*a* is covered with waterproof sheet 32. FIG. 41 is a cross sectional view taken along the line XLI-XLI in FIG. 39. A through-hole 11 is located in side surface 21 of housing 15, and flexible portion 8*b* of substrate 8*k* extends through through-hole 11 to the back side of housing 15. The leading end of flexible portion 8*b* is connected to a connecting member 17 located on a surface of a substrate 16. Connecting member 17 may be a pad electrode, for example. Substrate 16 is any substrate located in the internal space of the housing. Still another component may be located on substrate 16.

In summary, the structure of the electronic device according to the sixth embodiment can be expressed as follows. The electronic device according to the sixth embodiment includes substrate body 8*a* serving as a base including first surface 41 and second surface 42 facing the opposite sides to each other, dome switch 3 located on first surface 41, waterproof sheet 32 located to include a portion covering dome switch 3, and adhesive layer 33 located on at least part of waterproof sheet 32. Waterproof sheet 32 is affixed to another component with adhesive layer 33 so as to leave watertight space 6 including dome switch 3. The other component is housing 15, and substrate body 8*a* serving as a base is located along housing 15.

In the sixth embodiment, effects similar to those of the first embodiment can also be obtained. In the sixth embodiment, since waterproof sheet 31*k* only needs to be affixed to housing 15 rather than substrate body 8*a*, the assembly operation is easy.

Figure 42:
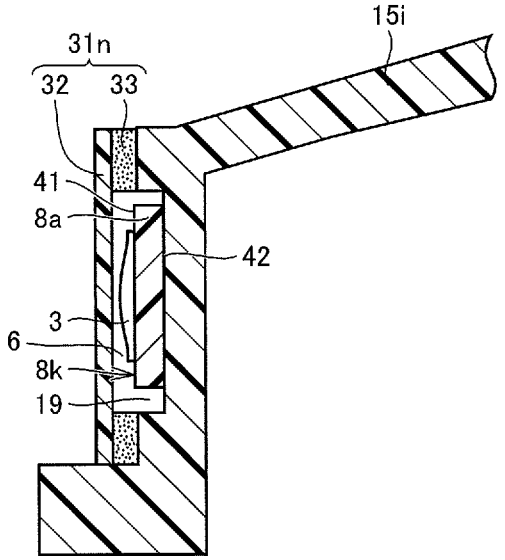
FIG. 42 is a cross sectional view of a variation of the electronic device according to the sixth embodiment based on the present disclosure.

Although the sixth embodiment describes housing 15 by way of example, the shape of the housing is not limited to housing 15. Although the sixth embodiment describes the example in which substrate body 8*a* is located on flat side surface 21 of housing 15, a housing 15*i* with a recess 19 may be adopted as shown in FIG. 42, for example. In the example shown in FIG. 42, substrate body 8*a* is housed in recess 19. Second surface 42 of substrate body 8*a* is in contact with the bottom surface of recess 19. As seen from the left side in FIG. 42, recess 19 is located in an area slightly larger than the outer shape of substrate body 8*a*.

Some of the above-described embodiments may be combined as appropriate and employed.

Although the term "electronic device" has been used for description, the electronic device has a broad concept including, for example, a mobile phone, a personal digital assistant, a tablet terminal, a personal computer, a game machine, a television set, a portable music player, a CD (Compact Disc) player, a DVD (Digital Versatile Disc) player, a calculator, an electronic notebook, an electronic dictionary, a digital book reader, a digital camera, a video camera, a radio set, a navigation system, measuring instrument, and the like. A smartphone is included in the concept of a mobile phone or a personal digital assistant.

Although the present disclosure has been described and illustrated in detail, it is clearly understood that the same is by way of illustration and example only and is not to be taken by way of limitation, the scope of the present disclosure being interpreted by the terms of the appended claims.

The invention claimed is:

1. An electronic device comprising:

a base including a first surface and a second surface facing opposite sides to each other;

a dome switch located on the first surface;

a waterproof sheet located to include a portion configured to cover the dome switch; and an adhesive layer located on at least part of the waterproof sheet, the waterproof sheet integrally including a first portion covering the first surface and a second portion covering the second surface so as to enclose the base, the waterproof sheet being bent between the first portion and the second portion, a section where the first portion and the second portion meet each other being bonded so as to provide a watertight space containing the dome switch, wherein at least part of the section where the first portion and the second portion meet each other is sandwiched between waterproof adhesive sheets from both sides with the first portion and the second portion being overlaid one on the other, one of the waterproof adhesive sheets seals a place where an end of the first portion is in contact with the flexible portion, and an other of the waterproof adhesive sheets seals a place where an end of the second portion is in contact with the flexible portion.

2. The electronic device according to claim 1, wherein the waterproof sheet is folded back to the second surface and is affixed to the second surface with the adhesive layer.

3. The electronic device according to claim 1, wherein the waterproof sheet is affixed to the first surface with the adhesive layer.

4. An electronic device comprising:

a base including a first surface and a second surface facing opposite sides to each other;

a dome switch located on the first surface;

a waterproof sheet located to include a portion configured to cover the dome switch; and a flexible portion configured to extend from the base, the waterproof sheet integrally including a first portion covering the first surface and a second portion covering the second surface so as to enclose the base, the waterproof sheet being bent between the first portion and the second portion, a section where the first portion and the second portion meet each other being bonded so as to provide a watertight space containing the dome switch, wherein at least part of the section where the first portion and the second portion meet each other is sandwiched between waterproof adhesive sheets from both sides with the first portion and the second portion being overlaid one on the other, one of the waterproof adhesive sheets seals a place where an end of the first portion is in contact with the flexible portion, and an other of the waterproof adhesive sheets seals a place where an end of the second portion is in contact with the flexible portion.

5. The electronic device according to claim 4, wherein at least part of the section where the first portion and the second portion meet each other includes a heat weld where the first portion and the second portion are bonded together.

* * * * *